United States Patent [19]

Smernoff

[11] Patent Number: 4,969,411

[45] Date of Patent: Nov. 13, 1990

[54] TRACK-TO-TRACK ADAPTOR SYSTEM FOR GENOA LEAD CAR ADJUSTMENT

[76] Inventor: Gerald N. Smernoff, 7005 Nevis Rd., Bethesda, Md. 20817

[21] Appl. No.: 407,073

[22] Filed: Sep. 14, 1989

[51] Int. Cl.[5] ..... B63H 9/10

[52] U.S. Cl. ..... 114/204; 114/39.1; 114/112

[58] Field of Search ..... 114/39.1, 111, 112, 114/204, 205, 218

[56] References Cited

U.S. PATENT DOCUMENTS

| | | | |
|---|---|---|---|
| 4,502,406 | 3/1985 | Merry | 114/112 |
| 4,651,668 | 3/1987 | Melrose | 114/112 |
| 4,719,869 | 1/1988 | Harken et al. | 114/204 |

*Primary Examiner*—Joseph F. Peters, Jr.
*Assistant Examiner*—Jesus D. Sotelo
*Attorney, Agent, or Firm*—Sughrue, Mion, Zinn, Macpeak & Seas

[57] ABSTRACT

A track-to-track adaptor system is mounted to an elongated first track fixedly mounted to and extending longitudinally or transversely along a sailing yacht. The adaptor system includes a lead car system having a relatively short length second track with a car slidably mounted thereon for moving longitudinally of the second track. A control system includes at least a portion mounted to the second track for adjusting the longitudinal position of the car on the second track. A sheave block is mounted on the car for movement therewith and receives a line connected to a movable portion of the yacht sail. A plurality of slides or adaptors including at least one locking slide are fixedly mounted to the bottom of the second track and in longitudinal alignment and at spaced longitudinal positions along the second track. The slides are engaged to the first track. The locking slide is locked to the first track at given positions for controlling the position of a second track to meet varying sailing conditions depending on wind velocity, wind direction and size of sail to maximize the efficiency of the yacht in sailing relative to the wind. A set screw or piston rotatably mounted on the locking slide projects into a selected one of a plurality of vertical holes within the first track for fixing the lead car system at a given position.

9 Claims, 2 Drawing Sheets

TRACK-TO-TRACK ADAPTOR SYSTEM FOR GENOA LEAD CAR ADJUSTMENT

BACKGROUND OF THE INVENTION

1. Field Of The Invention

This invention relates to lead car systems for medium to large sized sailing yachts for adjusting the genoa lead block position under load, and more particularly to a track-to-track adaptor system to permit the addition of new and different tracks or car systems to be added to previously installed track for permitting a single lead car system to handle various sized genoa and jib head sails under various wind conditions.

The ability to adjust the genoa lead position under load is crucial for efficient sailing. By moving the lead forward, the genoa or jib head may be powered up when coming out of each tack, or when sailing through wind lulls. By shifting the car aft of its normal position, the genoa or jib sail may be depowered to maintain the yacht upright in heavy wind gusts.

Lead car systems have been developed for yachts which do not race but simply cruise. By having adjustable lead cars with roller reefing genoa systems as the genoa sail is reefed by rolling it up about the head stay, the lead car position must be moved to compensate for the reduced size of the sail.

Harken Yacht Fittings of Pewaukee, Wis., have developed a number of lead car systems to meet the size of the yacht and the nature of the sails being handled. Harken® lead car systems are employed both to shift a sheave blocks longitudinally of the yacht on side tracks mounted to the deck adjacent to the opposite side rails of the yacht, or to control the position of a sheave block on an existing track transversely across the deck, cabin top or cockpit. Such Harken® systems permit control lines to be carried by the lead car system, partially mounted on the lead car system short linked track, or on an adjacent area of the deck where such track is fixed. Alternatively, control lines may be extended back to the cockpit such that the crew can operate the lead car system without leaving the cockpit and from the high side of the yacht, changing on each tack. The Harken lead car systems are quite sophisticated. In Harken® lead car system #3, individual cars are provided on side-by-side inboard and outboard, short length tracks fixed to the deck of the yacht and extending longitudinally of the yacht. In the Harken® lead car system #4, four short length tracks are employed for the number 1, 2 and 3 genoas, as two sets of inboard and outboard tracks. A single adjuster tackle has a single adjusting control line led aft to a winch which moves all four cars. Common shock cords connected to multiple cars bias the cars to an aft-retracted position on the tracks.

The Harken® lead car systems have developed to meet the needs, particularly of the blue water racing yachts, from the simple sheave block carried by a track slide as set forth in Barkley U.S. Pat. No. 2,453,357, issued Nov. 9, 1948. The principles of genoa and jib sail adjustment for varying wind direction conditions, wind speed conditions, and for different size yacht head sails have remained constant. The lead car or block systems developed to date, particularly those requiring multiple inside and outside tracks and separate cars, car system the most desired position for the lead car system sheave relative to the head sail employed under given wind conditions, which may be locked at that desired position along the existing deck track, which is relatively inexpensive, and which may be readily employed on yachts of various lengths.

Description Of The Preferred Embodiment

Figure 1:
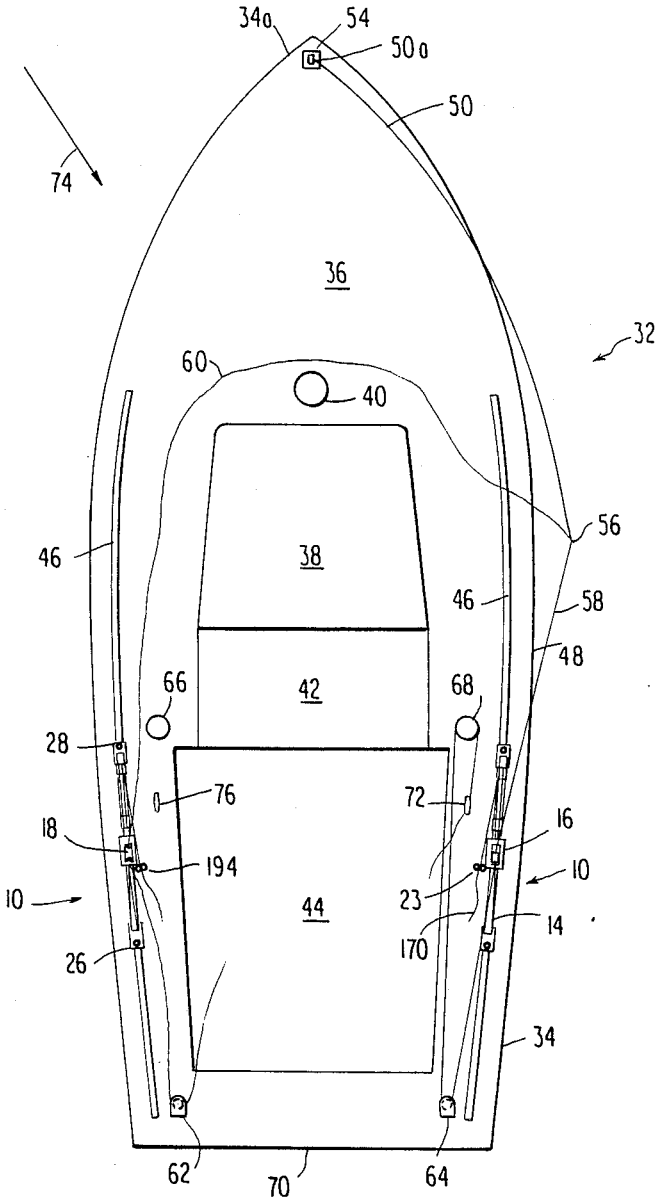
FIG. 1 is a top plan view of a sailing yacht employing a track-to-track adaptor system for genoa lead car adjustment mounted to an existing longitudinally extending main track on each side of the yacht deck, and forming a preferred embodiment of the invention.

Referring to the drawings, the track-to-track adaptor system for a genoa lead car adjustment is indicated generally at 10, and comprises a modification of a typical lead car system indicated generally at 12. In this case, the lead car system 12 is a system commercially sold by Harken Yacht Fitting. It includes a given length track 14, a lead car 16 supporting a relatively large diameter sheave or pulley wheel 18, a first control block 20 rotatably mounted to one end of the lead car 16, a second control block 22 pivotably mounted to forward end **14*a* of the short length track 14, a cam cleat 23 mounted to one side of the lead car 16, and a shock cord biasing assembly 24 extending to the other, aft end 14*b* of the short length track 14. In addition to the lead car system 12, the track-to-track adaptor system 10 includes two locking slides or adaptors 26, 28, at respective ends 14*a*, 14*b* of the lead car system track 14, and if needed or desired, one or more intermediate slides or adaptors 30 fixed to the bottom of the led car system track 14**.

In FIG. 1 the sailing yacht, indicated generally at 32, has a hull 34 with a relatively flat deck 36 from which rises a cabin top 38 behind the mast 40, and which opens via hatch 42, to the yacht hull interior. A cockpit 44 extends aft of the hatch 42. Such arrangement is as is the existence of a standard or conventional, existing main deck track 46 on each side of the deck 36 running from the aft end of cockpit 44 along a rail 48 at the side of the hull, and inboard thereof, to a position just forward of mast 40.

A track-to-track adaptor system 10 is slidably mounted on each existing main deck track 46 for permitting the lead car system 12 to be adjustably fixed at a given position, anywhere along the length of the existing track 46, from one end to the other, depending upon the given best initial position for a jib or genoa head sail. A relatively large genoa sail 50 is shown fixed along its luff **50*a* to the yacht fore stay 54 with the tack of the sail, at the bottom of luff 50*a* coupled to a deck fitting adjacent the face stay 54. The clew 56 of the sail forms an attachment for starboard jib sheet 58 which controls the positioning of the genoa sail 50 on the starboard (right) side of the yacht 32. A port genoa sheet 60 is suitably attached by a bowline knot 160 to the clew 56 via a grommet 57, FIG. 2, and the port genoa sheet 60 extends to the port side track-to-track adaptor system 10. The yacht includes mounted to the deck 36 adjacent to transom 70, turning blocks 62 64 on the port and starboard sides, respectively. The yacht further includes main deck winches 66, 68 to opposite sides of the cabin top at the forward end of the cockpit for winching in the starboard and port jib sheets 58, 60, respectively. The starboard jib sheet 58 is leaved through turning block 64, and several turns of sheet 58 are wrapped around the drum of the starboard side main deck winch 68 with the free end of the jib sheet 58 cleated at cleat 72 on that side of the cockpit. On the opposite side, the leeward (port) genoa sheet 60 is slack, connects to the port side lead car system 10, and extends about the sheave of the port side turning block 62, with the free end falling into the cockpit 44** on that side.

With the wind, as indicated by arrow 74, FIG. 1, coming across the deck from the port side to the starboard side, the sailing yacht is sailing on a port tack. Upon tacking, the bow 34*a* passes through the wind 74, and the genoa sail moves from the starboard side position shown in FIG. 1 to the port side. The starboard genoa sheet 58 is slackened, and the port genoa sheet 60 drawn taut by wrapping the free end of the port side genoa sheet 60 about the port side main winch 66, and the free end then cleated down to a port side cleat 76.

Figure 2:
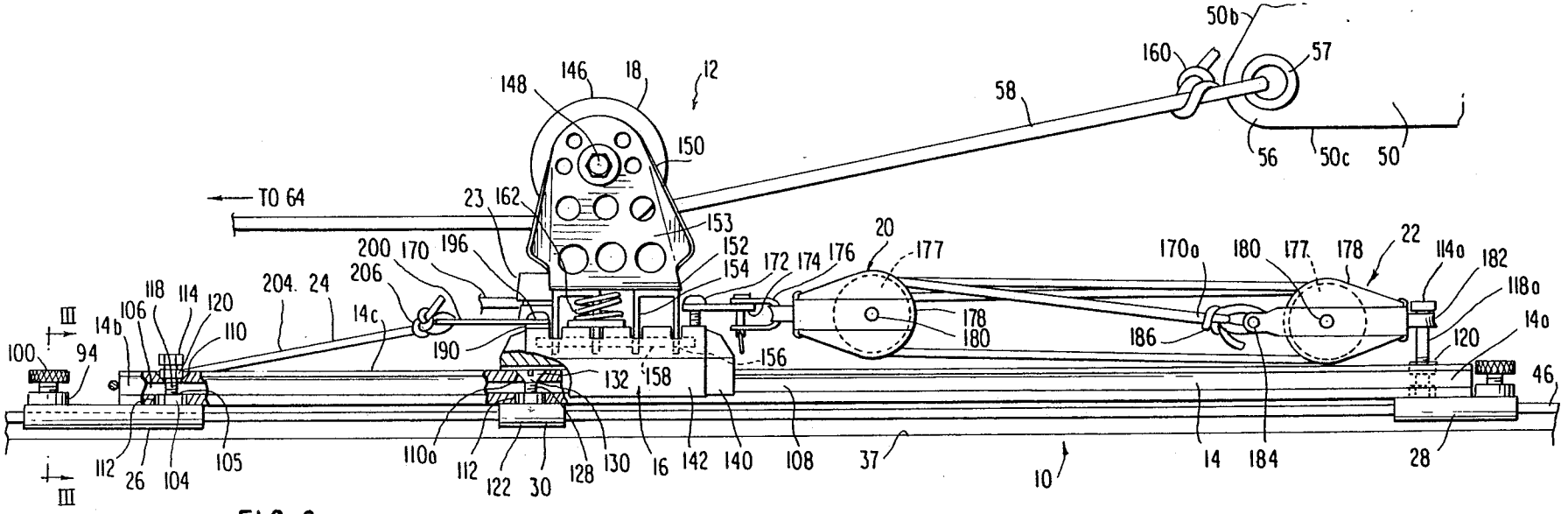
FIG. 2 is a side elevational view of one of the track-to-track adaptor systems of FIG. 1.
Figure 3:
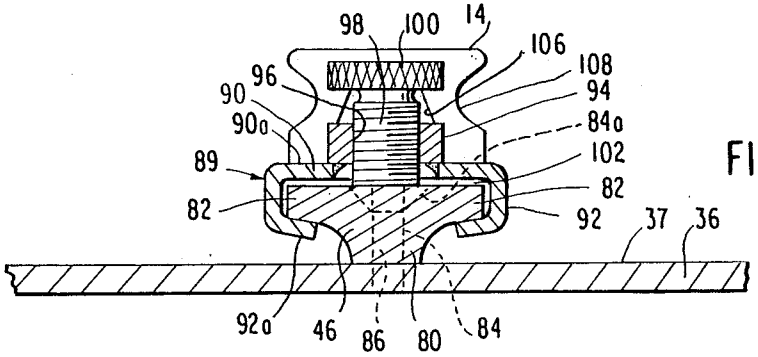
FIG. 3 is a sectional view about lines III—III of FIG. 2 of a portion of the track-to-track adaptor system showing the mounting of one locking slide to the short length track of the lead car system and in turn, the locking slide ada[tomg to the existing main track of the yacht.

Referring to FIGS. 2 and 3, the details of the track-to-track adaptor system for genoa lead car adjustment may be seen, both in terms of the existing commercially available hardware and the added components of the track-to-track adaptor system 10. In addition, the nature in which the track-to-track adaptor system 10 is mounted to an existing main track 46 may be fully appreciated, as well as the mechanism for locking the short length lead car system track at an adjustable set position along the existing main deck track 46 for the yacht 32.

In FIG. 2 only a fragmentary portion of the existing main deck track 46 mounted to the top of the upper surface 37 of deck 36 is shown. Track 46 is of fat, T-shape in vertical cross section as per FIG. 3, including a narrow base 80 which flares outwardly at the top, forming flanges 82 to opposite sides. The main deck track 46 may be a solid metal extrusion and provided with center holes 84 at longitudinally spaced positions which holes are flared or conically counterbored at 84*a* at the top. At alternating holes 84, throughbolts 86 are provided for mounting the main deck track 46 to the deck adjacent to or spaced some distance inside of the rail, the bolts 86 passing through the deck 36. The other holes 84 which do not have bolts passing therethrough, function, as in the Barkley U.S. Pat. No. 2,453,357, to receive set screws or other locking means on the slides. In the track-to-track adaptor system 10 of the present invention those holes 86 receive selectively a locking set screw for locking slides 26, 28 forming components of the track-to-track adaptor system 10. Further, the existing track 46 may be of the configuration shown or, alternatively, that of track 16 of the Barkley U.S. Pat. No. 2,453,357, or it may take the form of the short length lead car system track 14.

The locking slides 26, 28 may be identical to the piston or screw type, but oppositely oriented, and are fixedly mounted to aft end 14*b* and forward end 14*a*, respectively of track 4. The function of the locking slides is to facilitate rapid longitudinal shift in position of the standard lead car system 12, and the locking of the lead car system short length track 14 at a given position along the length of existing main deck track 46. In that respect, the locking slides 26, 28 are modified forms of commercially available lacking slides. In that respect, each slide 26, 28 is formed of a metal body 89 of inverted U-shaped, vertical cross sectional configuration, including a base 90 and laterally opposed side walls 92 with the side walls terminating in reversely bent lower ends 92*a* which extend toward each other and form a cavity 102 to receive the laterally outwardly projecting flanges 82 of the existing track 46. The reversely turned ends 92*a* of the locking slides 26, 27 are spaced apart a distance less than the overall width of the existing main deck track 46, upon which they mount and slide.

Conventionally a circular boss 94 is fixed as by welding to the upper face 90*a* of base 90, the boss being provided with a tapped hole 96 which receives a threaded shank 98 of a set screw 100. The set screw 100 is therefore threaded into and out of the cavity 102 defined by one of side walls 92 of each locking slide 26 28. The threaded shank 98 of the set screw 100 is sized so as to be readily positioned within one of the holes 84 of the existing main deck track 46 devoid of a through bolt 86, thereby locking the slide at a longitudinally adjusted position on that track.

At a longitudinally spaced position from the locking slide set screw 100 the locking slides have been modified by having welded on the upper surface 90*a* thereof, a hex nut 104, provided with a threaded bore 105.

This hex nut 104 facilitates the fixed coupling of each locking slide 26, 28 to a respective position such as ends 14*b*, 14*a* of the lead car system short length track 14.

The lead car system short length track 14 is also modified to adapt to and partially form the track-to-track adaptor system 10.

Track 14, whose cross section may be seen in FIG. 3, is a hollow metal extrusion, of modified rectangular form, having a trapezoidal bore 106 running longitudinally through the center of the same. Additionally, opposite sides thereof have concave recesses or grooves 108 for supporting and slidably maintaining car 16 thereon. A series of longitudinally spaced holes 110 are drilled within track 14 at the lateral center thereof, which holes 110 are outwardly flared, conical counterbores 110*a* at the top thereof. As described to this extent, track 14 is conventional.

The adaptor system 10 requires the existence of circular smooth counterbores 112 within the bottom of through holes 110 at the opposite ends 14*a*, 14*b* of track 14. Those counterbores are of a diameter in excess of the diameter of the hex nuts 104 which project upwardly from the top surface 90*a* of the locking slides 26, 28 and the nuts 104 are positioned thereon. Further, the depth of the counterbores 112 must be in excess of the height of the hex nuts 104 so as to receive the same.

To effect fixed mounting of the locking slides 26, 28 to respective ends 14*b*, 14*a* of track 14, bolts 114, and 114*a*, respectively, are provided. The bolts include threaded shanks 118, 118*a* and threadably support lock nuts 120. Threaded shank bore 118 is of a length so as to pass through the smooth holes 110 at end 14*b* of the lead car system track 14, and is threaded into a hex nut 104 welded to the tops of the locking slide 26 is. Bolt 114 is threaded into the locking nut 104 until the slide 26 is locked to end 14*b* of the track 14 and in line therewith. The same coupling is achieved for locking slide 28 via a longer length bolt 114*a* and for intermediate adaptors.

In the illustrated embodiment of the invention, there is additionally as part of the track-to-track adaptor system 10 an intermediate slide 30 which includes a slide body 122 formed of the same U-shaped metal stock as locking slide body 89. In this case, intermediate slide body 122 has its base 124 provided with a single tapped hole 126 which receives the threaded shank 128 of a screw 130 whose conical headed end 132 is received within the conical counterbore 110*a* within the upper face 14*c* of track 14. The intermediate slide 30 is illustrated as being positioned uniformly, halfway between locking slides 26, 28. If several intermediate slides are employed (depending upon the overall length and strength of the lead car system track 14) the intermediate slides 30 may be spaced at equal distances from each other and from the locking slides 26, 28.

The only other modification of the lead car system 12 to form the track-to-track adaptor system 10 is the use of the somewhat longer bolt 114*a* at the forward end 14*a* of track 14 which performs two functions. One function is to lock via lock nut 120, the locking slide 28 to end 14*a* of the track. In addition, the thread shank 118*a* of bolt 114 rotatably supports the second control block 22, while the first control block 20 is pivotably supported in line therewith at the forward and of lead car 16.

In all other respects, the lead car system 12 is conventional except for a mounted cam cleat for adjusting lines, and its components will be described briefly.

Lead car 16 is of generally inverted U-shaped cross sectional configuration, having a horizontal base 140, extending across and above track 14 with vertical side walls 142 extending downwardly on opposite sides of track 14. In the Harken system illustrated, anti-friction ball bearings are formed within the car 16 with balls in contact, through continuous loop passages, the grooves 108 on opposite sides of the track 14.

The large diameter sheave or pulley 18 has a cylindrical sheave or pulley wheel 146 mounted by way of a pin 148 within a U-shaped metal bracket 150, from whose base 152 uses laterally spaced integral side wall 153 and whose base has integrally formed or welded thereto four longitudinally spaced plates 154, which extend downwardly from the bottom of the base 152. They have aligned axial bores 156, through which pass axle or pintle 158 which mounts to base 140 of car 16 and permits the bracket 150 to rotate about a horizontal axis in line with track 14 for limited rotation from side to side. Slots are formed within the base 140 of the car to receive the plates 154 to facilitate limited movement from side to side.

To maintain the bracket 150 in a vertical, upright position, a helical coil compression spring 162 is interposed between the base 140 of car 16 and the bottom wall 152 of the U-shaped bracket. As may be appreciated from FIG. 3, the genoa 50 terminates at the intersection of leach 50*b* and foot 50*c* of the sail in a clue 56, with the grommet 57 receiving one end of the starboard side genoa sheet 58 which is tied thereto by way of a bowline knot 164. The genoa sheet 50 extends through the passage defined by the sides of the U-shaped bracket 150 side walls 153, bottom 152 and pulley wheel 146 of the sheave 18. The pulley wheel 146 has a circular groove within its periphery with the genoa sheet 58 centered therein in passing through sheave 18. The genoa sheet 58 continues in the direction of turning block 64, FIG. 1, maintaining tension on the genoa 50 via tack 56.

To control the longitudinal position of the car 16, and thus sheave 18, under load, a four-to-one block and tackle arrangement is employed made up by control blocks 20, 22 and cam cleat 23 and control line 170. Control line 170 leads aft and may be controlled from the cockpit. Mounted to the top face 16*a* of car 16 at its forward by way of screws 172 is a triangular shaped plate 174 to which mounts a shackle 176. The shackle 176 releasably connects control block 20 to the leading end of car 16. Each control block 20 and 22 includes two sheave or pulley wheels 177 mounted for rotation within a block casing 178 by a common pin 180 which extends through the casing from side to side. The pulley or sheave wheels 177 are free to rotate about the pin 180 axis. With respect to control block 22, its casing mounts by way of a cleavis 182 to shank 118*a* of bolt 114*a*. The opposite end of the casing 178 is provided with a transverse pin 184 to which one end 170*a* of the control line is tied via a bowline knot 186. The control line 170 extends, therefore, from the center of control block 22 at pin 184 to one of the pulley wheels 177 of control block 20, back to one of the wheels 177 of control block 22, back to the other of the wheels 177 of control block 20, back to the second wheel of control block 22, and thence to cam cleat 23.

The cam cleat 23 is conventional, being provided with a flat horizontal base 190 supporting two spring biased, oppositely rotating cams 194, having serrated facing surfaces which jam against opposite sides of the control line to lock the control line and prevent the control line 170 from moving in a forward direction, but permitting it to move aft to pull the car 16 in the direction of the bow of the yacht, from left to right (FIG. 2). The cam cleat 23 base 190 is mounted on a metal plate or strip 196 which is fixed to the upper face 16*a* of car 16 via two mounting screws 196 which commonly, fixedly mount strip 196 and a U-shaped plate 200 which projects rearwardly from the car 16 and longitudinally in line therewith. A piece of resilient shock cord 204 is tied at opposite ends to the U-shaped plate 200, by suitable bowline knots 206, and the shock cord loop is led over the aft end 14*b* of track 14 and held within the side grooves 108 of the track 14 by the tension within the shock cord due to the stretch thereof. The shock cord provides a biasing force in a direction from right to left (FIG. 2) towards the stern of the yacht tending to cause the car 16 to move rearwardly on track 14 upon release of the control line 170 from cam cleat 123.

In operation, depending upon the wind velocity and wind direction and the size of the sail selected, the track-to-track adaptor system 10 is shifted longitudinally along the length of the existing main deck track 46 and locked thereto. In the case of FIG. 2, the starboard track-to-track adaptor system is reset by rotating the set screws 100 (or spring biased pistons, of the two screws or pistons, thereby locking slides to a raised or extended position removing the threaded shanks 98 from the holes 84 of the main deck track 46. The intermediate slide 30 has no set screw and simply maintains the near face-to-face positioning and slidably coupling between track 14 of the lead car system 12 and the main deck track 46. Assuming that the head sail 50 is a relatively large genoa sail (180% genoa) the clue 56 of that sail would be well aft of the mast 40 position and near the front of the cockpit 44 of the yacht. Thus the track-to-track adaptor system 10 operates to permit shifting of the lead car system 12 forwardly and rearwardly along the side of the yacht hull, over a longitudinal extent well in excess of the length of the lead car system track 14. Under normal set up, the lead car 16 would be initially positioned at an intermediate position along the length of the lead car system track 14 with the control line jammed by cam cleat 23 between the two spring biased cams 194. Under actual sailing conditions, the lead car system 12 is operated in its normal fashion; under load by pulling or releasing the control line 170. Pulling in the direction of the turning block as indicated by the arrow 171 (FIG. 2). the car 16 will be moved forwardly in the direction of sail 50 which requires some force, but can be accomplished, by hand or through an available winch due to the four-to-one blocking system provided by control blocks 20, 22. This adjustment can be made momentarily, as when tacking, during wind lulls, or the like. Upon release of the control line 170 from the cam cleat 23, the tendency is for the car to move rearwardly in the direction of the turning block under the forces acting from the sail 50 through the genoa sheet 158.

Further, by use of the track-to-track adaptor system 10, when changing from a close hauled condition of sailing (as close as possible into the wind to an off-wind condition such as a beam reach or a broad reach, if the available adjustment provided by the short length track 14 of the lead car system 12 is insufficient, the locking slides 26, 28 may have their set screws 100 loosened, permitting a ready shift of the short length track of the lead car system to a new and more efficient position for the sail 50 with respect to the point of sail dictated by the broad reach or beam reach undertaken.

For larger yachts, such as a Maxi Racing Yacht of 70', the track-to-track adaptor system may be employed in fine tuning a main sheet traveler defined by an appropriate lead car system of a conventional form similar to that at 12 (FIG. 2) via the track-to-track adaptor system 10 of the present invention and extending transversely of the yacht hull 34.

From the foregoing, it may be seen that the present invention provides a relatively simple, inexpensive adaptor apparatus which permits the sailor to employ the full length of an existing deck track system (or transverse traveler system) to insure the proper jib or main sail sheet lead position under all wind and sea conditions. The adaptor system 10 is particularly useful since it operates with all of the head sails from the smallest jib to the largest genoa through the same block sheave, thereby eliminating the necessity to employ a series of longitudinally aligned, end-to-end positioned lead car systems utilizing short length tracks fixed to the deck of the yacht.

While an embodiment of the invention has been described in detail, it will be evident to those skilled in the art that the invention may be embodied otherwise without departing from its spirit and scope as expressed by the claims appended hereto.

What is claimed is:

1. A track-to-track adaptor system comprising, in combination:

an elongated first track fixedly mounted to and extending along a sailing yacht, a lead car system including a relatively short length second track, a car slidably mounted on said second track for moving longitudinally along said second track, a control system including at least a portion thereof mounted to said second track for adjusting the longitudinal position of said car on said second track, a sheave block mounted on said car for movement therewith for connection to a movable portion of a sail, a plurality of slides, means fixedly mounting said slides to the bottom of said second track in longitudinal alignment therewith, and at longitudinally spaced positions, said slides being slidably mounted to said first track such that said second track moves along and over the first track, and means for selectively locking at least one of said slides to said first track at given positions therealong for controlling the positioning of said sail to meet varying sailing conditions, depending on wind velocity, wind direction and size of sail, for achieving efficient sailing of said yacht relative to said wind.

2. The track-to-track adaptor system as claimed in claim 1, wherein said slides include two locking slides fixedly mounted, respectively, at opposite ends of said second track, and wherein said means for selectively locking said slides to said first track comprises set screws carried by said two locking slides and engageable with said first track.

3. The track-to-track adaptor system as claimed in claim 2, wherein said first track includes a plurality of longitudinally spaced holes within said first track aligned with said set screws and sized to receive shanks of said set screws for locking said locking slides to said first track at said given positions.

4. The track-to-track adaptor system as claimed in claim 3, wherein each of said locking slides comprise a body of inverted U-shaped, cross sectional configuration, including a flat base overlying said first track, and extending transversely the width of the first track, said base including a threaded bore in line with said set screw and receiving a threaded shank of said set screw, and wherein said set screw includes a locking nut threaded to said shank, and engageable with the face of said second track remote from said locking slide for fixedly locking said slide to said second track.

5. In a lead car system for a yacht having an elongated first track fixedly mounted to and extending longitudinally on a sailing yacht, said lead car system including a relatively short length second track, a car slidably mounted on said second track for movement longitudinally of said second track, a control system, at least a portion of said control system being mounted to said second track for adjusting the longitudinal position of said car on said second track, a sheave block mounted on said car for movement therewith and for connection to a movable portion of a sail, the improvement comprising:

a plurality of slides, means for fixedly mounting said slides to the bottom of said second track in longitudinal alignment therewith at longitudinally spaced positions, said slides being slidably mounted to said first track, and maintaining said second track overlying said first track and in alignment therewith, and means for selectively locking at least one of said slides to said first track at given positions therealong for controlling the position of said sail to meet the varying sailing conditions depending upon wind velocity, wind direction and size of sail to facilitate the efficient sailing of said yacht relative to said wind.

6. The lead car system as claimed in claim 5, wherein said plurality of slides includes two locking slides respectively fixedly mounted at opposite ends of said second track, and wherein said means for selectively locking said at least one of said slides to said first track comprises a set screw carried by said locking slides and engageable with said first track.

7. The lead car system as claimed in claim 6, wherein a plurality of longitudinally spaced holes are provided within said first track in line with the axis of said set screws, and respectively selectively receiving the same for locking said locking slides.

8. The lead car system as claimed in claim 7, wherein said locking slides each include a threaded bore, opening to said second track, and wherein said means for fixedly mounting said slides to the bottom of said second track further comprises threaded screws bearing a locking nut, having threaded ends threaded into said threaded bore of said locking slide, and wherein said locking nut mounted to said screw engages the face of said second track opposite that proximate to said locking slide to fixedly lock said locking slides to said second track at opposite ends thereof.

9. The lead car system as claimed in claim 8, wherein each of said locking slides comprises a metal body of inverted U-shaped configuration sized to and slidably engaging said first track, said body including a flat base overlying said first track and underlying said second track, a lock nut welded to the surface of said base facing said second track, and projecting upwardly therefrom, and wherein said second track includes a hole passing therethrough and receiving said screw, and wherein said holes within said second track at opposite ends thereof include counterbores within the lower face thereof, overlying said locking slide base, and receive said welded lock nut with the threaded shank of said screws being threadedly engaged therewith.

* * * * *